US009850713B2

(12) United States Patent
Haci

(10) Patent No.: US 9,850,713 B2
(45) Date of Patent: Dec. 26, 2017

(54) SYSTEMS USING CONTINUOUS PIPE FOR DEVIATED WELLBORE OPERATIONS

(71) Applicant: QUADRUM ENERGY LLC, Houston, TX (US)

(72) Inventor: Marc Haci, Houston, TX (US)

(73) Assignee: MUST HOLDING LLC, Houston, TX (US)

( * ) Notice: Subject to any disclaimer, the term of this patent is extended or adjusted under 35 U.S.C. 154(b) by 253 days.

(21) Appl. No.: 14/868,246

(22) Filed: Sep. 28, 2015

(65) Prior Publication Data

US 2017/0089141 A1 Mar. 30, 2017

(51) Int. Cl.

| | |
|---|---|
| ***E21B 7/06*** | (2006.01) |
| ***E21B 17/20*** | (2006.01) |
| ***E21B 19/22*** | (2006.01) |
| ***E21B 19/08*** | (2006.01) |

(52) U.S. Cl.

CPC ..... *E21B 7/06* (2013.01); *E21B 17/20* (2013.01); *E21B 19/08* (2013.01); *E21B 19/22* (2013.01)

(58) Field of Classification Search

CPC ..... E21B 7/06; E21B 17/20; E21B 17/206; E21B 19/08; E21B 19/22

See application file for complete search history.

(56) References Cited

U.S. PATENT DOCUMENTS 5,215,151 A 6/1993 Smith et al.
5,291,956 A 3/1994 Mueller et al.
5,311,952 A 5/1994 Eddison et al.
5,435,395 A 7/1995 Connell
5,553,680 A 9/1996 Hathaway
6,273,188 B1 8/2001 McCafferty et al.
6,315,052 B1 * 11/2001 Sola ..... E21B 19/22 166/381
6,332,501 B1 12/2001 Gipson
6,439,618 B1 8/2002 Beeman et al.
6,446,737 B1 * 9/2002 Fontana ..... E21B 4/02 175/107
6,494,297 B1 12/2002 Myklebust
6,516,892 B2 * 2/2003 Reilly ..... E21B 19/24 166/384
6,571,888 B2 6/2003 Comeau et al.
6,763,890 B2 7/2004 Polsky et al.
7,185,708 B2 3/2007 Wood et al.
7,243,739 B2 7/2007 Rankin, III
7,347,257 B2 * 3/2008 Van Way ..... E21B 19/22 166/77.2
7,469,755 B2 * 12/2008 Borst ..... E21B 19/22 166/384
7,481,280 B2 * 1/2009 Benge ..... E21B 7/20 166/384

(Continued)

*Primary Examiner* — Matthew R Buck
(74) *Attorney, Agent, or Firm* — Halit N. Yakupoglu

(57) ABSTRACT

A drilling system for use in rotary coiled tubing drilling of deviated wellbores is provided. The drilling system includes a base, a derrick mounted on the base, a top drive system mounted on the derrick; and a coiled tubing module. The coiled tubing module is adapted to move the coiled tubing in and out of the deviated wellbore and coupled to the top drive system on the derrick. The coiled tubing module is carried and rotated by the top drive system to transfer torque to the coiled tubing moving in and out of the deviated wellbore to perform rotary coiled tubing drilling.

10 Claims, 5 Drawing Sheets

(56) References Cited

U.S. PATENT DOCUMENTS

| | | | | |
|---|---|---|---|---|
| 7,600,585 | B2 | 10/2009 | Patton et al. | |
| 7,640,999 | B2 | 1/2010 | Patton | |
| 7,909,106 | B2 * | 3/2011 | Van Way | E21B 19/07 166/380 |
| 8,627,896 | B2 | 1/2014 | Wood et al. | |
| 8,752,617 | B2 * | 6/2014 | Borst | E21B 19/22 166/77.1 |
| 8,919,458 | B2 | 12/2014 | Plop | |
| 9,546,517 | B2 * | 1/2017 | Zhou | E21B 3/04 |
| 2002/0029907 | A1 | 3/2002 | Carriers et al. | |
| 2003/0106715 | A1 * | 6/2003 | Clemmons | E21B 7/046 175/19 |
| 2006/0266555 | A1 | 11/2006 | Chen et al. | |
| 2012/0145380 | A1 | 6/2012 | Chen et al. | |

* cited by examiner

SYSTEMS USING CONTINUOUS PIPE FOR DEVIATED WELLBORE OPERATIONS

BACKGROUND

Field of the Invention

The present invention relates to systems for drilling or servicing wellbores, more particularly, to a coiled tubing system for drilling or servicing wellbores by employing a rotary continuous pipe.

Description of the Related Art

Hydrocarbon fluids such as oil and natural gas are extracted from subterranean formations or reservoirs by drilling wells penetrating the reservoirs. Directional drilling using steering techniques can form deviated wellbores to reach reservoirs that are not located directly below a wellhead or a rig. A deviated wellbore is a wellbore that is intentionally drilled away from vertical. A deviated wellbore can include one or more inclined portions and one or more horizontal portions. A variety of drilling systems and techniques have been employed to provide control over the direction of drilling when preparing a wellbore or a series of wellbores having deviated sections.

Traditionally oil and gas wells have been drilled using a drill string formed by connected drill pipes with a drill bit included at the lower end of the drill string. Drill pipes are steel pipes having connectable end sections allowing them to join with other drill pipes to form the drill string. The drilling operation, which is often called rotary drilling, is performed by rotating the entire drill string and the connected drill bit from a rig on the earth surface. At the rig, conventionally, two different types of equipment, either a top drive or a rotary table drive, can be used for generating the needed rotational power to rotate the drill string. Alternatively, only the drill bit can be rotated by a down-hole motor attached to the lower end of the string. The motor typically has a rotor-stator to generate torque as a drilling fluid passes through the motor, a bent housing to deviate the hole by the required amount and a bit rotatably supported at the end for drilling the bore.

As the drilling operation advances into the earth, additional drill pipes are added to the drill string to drill deeper. However, an important drawback with this drilling technology is the significant time and energy lost caused by adding and removing new drill pipes.

Coiled tubing has been a useful apparatus in oil field drilling and related operations. Coiled tubing drilling does not use individual sections of drill pipe that are screwed together. Instead, a continuous length of metal tubing is fed off of a reel and sent down the wellbore. In a typical coiled tubing operation the metal tubing is unreeled from a tubing coil for either drilling a wellbore or providing a conduit within open or cased wellbores for workovers. The potential of coiled tubing to significantly reduce drilling costs with respect to conventional drilling using drill pipe sections has been long recognized. Some of the potential cost saving factors include the running speed of coiled tubing units and the reduced pipe handling time. Furthermore, the coiled tubing has a smaller diameter than traditional drill pipe, resulting in generating a smaller volume of cuttings. In addition to reducing waste volumes, the surface footprint is smaller, the noise level is lower, and air emissions are reduced. Since coiled tubing offers an uninterrupted operation, it can also reduce formation damages caused by interrupted mud circulations.

Despite the significant potential cost savings by drilling with coiled tubing, coiled tubing cannot be rotated and this limits applications of coiled tubing in drilling and workover operations. As mentioned above a conventional drill string is rotated from the surface but because the coiled tubing supplied from and a portion of the coiled tubing remains on the reel, the coiled tubing cannot be rotated.

From the foregoing, there is a need therefore for a novel multi-task rig which overcomes the many disadvantages of the continuous coiled tubing drilling and conventional jointed pipe drilling.

SUMMARY

One aspect of the present invention includes a drilling system for use in rotary coiled tubing drilling of wellbores, comprising: a base, a derrick mounted on the base, a top drive system mounted on the derrick, and a coiled tubing module, adapted to move a coiled tubing in and out of the wellbore, coupled to the top drive system on the derrick so as to be carried and rotated by the top drive system to transfer torque to the coiled tubing moving in and out of the wellbore to perform rotary coiled tubing drilling.

Another aspect of the present invention includes a system for drilling wellbores with rotated coiled tubing, comprising: a derrick having a derrick top and a derrick floor positioned over a wellbore, a reel assembly including a reel structure adapted to support a reel of coiled tubing, a reel drive disposed on the reel assembly for unreeling the reel of coiled tubing by rotating the reel of coiled tubing about an axis of rotation that is substantially orthogonal to a vertical axis of the wellbore, a guidance system to align the coiled tubing with the wellbore as the coiled tubing is unreeled from the reel and advanced into the wellbore; and a top drive, disposed at the derrick top, coupled to the reel assembly for rotating the reel assembly about a rotation axis of the top drive that is substantially aligned with the vertical axis of the wellbore and thereby transmitting torque to the coiled tubing in the wellbore.

Yet another aspect of the present invention includes a method of wellbore drilling, comprising: providing a derrick having a derrick top and a derrick floor positioned over a wellbore, a top drive system, disposed at the derrick top, operating a jointed pipe drill string coupled to the top drive to drill a first section of the wellbore, and operating a coiled tubing from a coiled tubing module to drill a second section of the wellbore, wherein operating the coiled tubing comprising: coupling the coiled tubing module to the top drive, the coiled tubing module including a reel structure adapted to support a reel of coiled tubing and a reel drive, unreeling the coiled tubing by rotating the reel of coiled tubing using the reel drive and extending the coiled tubing into the wellbore, and rotating the coiled tubing module about a rotation axis of the top drive that is substantially aligned with the vertical axis of the wellbore and thereby transmitting torque to the coiled tubing extending into the wellbore.

BRIEF DESCRIPTION OF THE DRAWINGS

These and other aspects and features of the present invention will become apparent to those of ordinary skill in the art upon review of the following description of specific embodiments of the invention in conjunction with the accompanying figures, wherein.

DETAILED DESCRIPTION OF THE PREFERRED EMBODIMENTS

Figure 1:
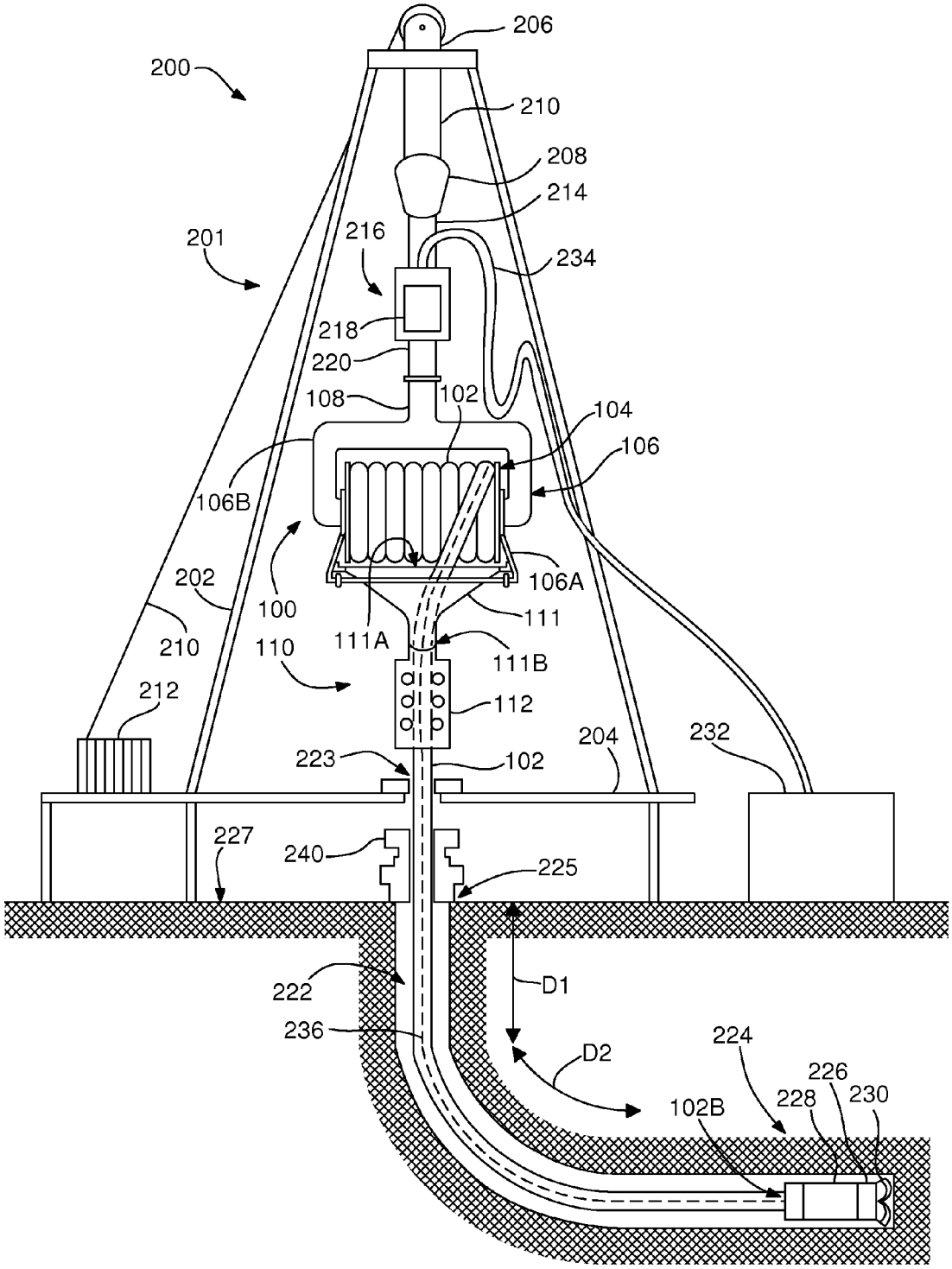
FIG. 1 is a schematic view of a system having a rig wherein an embodiment of a coiled tubing module of the present invention has been mounted on the rig.

The present invention provides embodiments of a rotary coiled tubing, or a rotary continuous tubing, system including a coiled tubing module installed on a drilling rig to conduct wellbore operations using rotary coiled tubing for drilling wellbores and/or servicing wellbores. The coiled tubing module of the present invention may also be referred to as rotary coiled tubing module, rotary continuous tubing module or continuous tubing module. The coiled tubing module of the present invention may be portable module which may be transported to various wellbore locations or rigs in various locations for use in, for example, hydrocarbon wells such oil and gas or other fluid wells. The rotary coiled tubing system may be a hybrid system so that the coiled tubing module may be adapted to be installed on a conventional jointed pipe drilling rig to provide rotatable continuous tubing for wellbore drilling operations and wellbore servicing operations. Accordingly, with this feature, the same drilling rig can be advantageously used for both rotary coiled tubing operations and conventional rotary jointed pipe operations.

In one embodiment, a coiled tubing module of the present invention comprises a reel structure adapted to support a reel of coiled continuous tubing and a reel drive adapted to rotate the reel to uncoil or coil the continuous tubing. In this embodiment the continuous tubing may be wound around the reel. The coiled tubing module may be adapted to engage with the drilling rig's power and mechanical systems, which systems may be essentially used to rotate a jointed pipe string when the drilling rig is used to conduct a rotary jointed pipe drilling operation.

Once the coiled tubing module is installed on the drilling rig, at least one rotary drive system of the rig may rotate the coiled tubing module about a drilling axis of the rig to apply rotation to the continuous tubing extending from the coiled tubing module into the wellbore. In one embodiment, as the coiled tubing module is rotated about a drilling axis, the continuous tubing is simultaneously unreeled from the reel of coiled tubing by rotating the reel of coiled tubing on the module. The reel of coiled tubing may be rotated by the reel drive on the coiled tubing module and about an axis which may be orthogonal to the drilling axis of the rig.

In one embodiment, the coiled tubing module may be mounted at an upper part of an oil or gas rig by the reel structure adapted to support the reel of coiled tubing. In this arrangement, an upper part of the reel structure may be brought into rotary driving engagement with a top drive of the rig to rotate the coiled tubing module and hence the tubing extending into the earth from the module. A lower part of the reel support may include a guide and injector system to align the coiled tubing with the wellbore and to straighten the coiled tubing as the coiled tubing is unreeled from the reel and advanced into the wellbore. The rotary coiled tubing system of the present invention may be employed as a fishing tool, e.g., a fishing conduit, in deviated wellbores as rotation may help the continuous tubing reach longer depths by overcoming drag effect. Such fishing tools may be easily delivered to catch failed Measurement-While-Drilling (MWD) tools or drill out blockages that may happen inside jointed pipe strings. However, as opposed to the rotary coiled tubing system of the present invention, excessive drag will prevent any conventional non-rotary coiled tubing from reaching extended depths or distances in deviated wellbores.

Using the system of the present invention a production hole may be drilled using both the rotary jointed pipe string and the rotary coiled tubing. In one process sequence, a first drilling operation may be performed using the jointed pipe string from the drilling rig to drill a first section of a wellbore, which may be surface or intermediate sections of the wellbore. In the following step a casing may be run in the first section of the wellbore and cemented. Next, a second drilling operation may be performed using a rotary coiled tubing from the same rig to continue drilling the production hole by drilling a second section of the wellbore. The diameter of the second section of the wellbore may be smaller than the diameter of the first section of the wellbore. The process may continue drilling third or fourth sections with the rotary coiled tubing. Typically, when it is completed, a wellbore may have three of more consecutive wellbore sections with reduced diameter, first diameter being the largest and the last diameter being the smallest, and corresponding casing and cementing.

The rotary coiled tubing system of the present invention may be employed to deliver logging tools to deviated wells without any other aid. Conventional coiled tubing systems need aids such as lubricants, tractors, agitators or simply a larger diameter coiled tubing (higher cost) to reach depths. Although these aids may offer partial solutions for delivering such tools, very often they do not guarantee reaching the final depth. Within the coiled tubing, a cable to supply electrical power and to transfer data may be included. The cable may establish a rapid data transfer line between a downhole tool within the wellbore and a control center on the surface to monitor and manage the drilling operation.

Referring to FIG. 1 there is shown a rotary coiled tubing drilling system 200 including a rig 201 and a rotary coiled tubing module 100 or rotary coiled tubing reel assembly, which will be referred to as coiled tubing module 100 hereinafter, mounted on the rig 201. The coiled tubing module 100 includes coiled tubing 102 which is continuous tubing. The rig 201 includes a derrick 202 supported on a rig floor 204 above the ground. The rig 201 includes lifting gear which includes a crown block 206 mounted to the derrick 202 and a traveling block 208. The crown block 206 and the traveling block 208 may be interconnected by a cable 210 which may be driven by drawworks 212 or another lifting mechanism to control the upward and downward movement of the traveling block 208. The traveling block 208 may have a hook 214 to hold a top drive system 216 or top rotary drive system which includes at least one motor 218 and a gripping tool 220 or quill located at the lower part of the top drive system 216. The motor 218 may be for example an electric motor or hydraulic motor (see FIGS. 3A-3C) or other type. The gripping tool 220 may be used to connect the coiled tubing module 100 to the top drive system 216. The top drive system 216 may be further supported by a carrier (not shown).

The top drive system 216 may be adapted to carry the coiled tubing module 100 by holding it above the rig floor 204. During a wellbore operation, the top drive system 216 rotates the coiled tubing module 100 to which the gripping tool 220 is connected and thereby rotating the coiled tubing 102 extending into a wellbore 222 through a rig floor opening 223 in the rig floor 204 and a drill opening 225 in the earth surface respectively. It is understood that wellbore operations refers to operations including either drilling or workovers, or both. The rotary action produced by the top drive system 216 applies torque to the coiled tubing extending within the wellbore 222. The top drive system 216 may be operated to rotate the coiled tubing module 100 and hence the coiled tubing 102 in either direction. During wellbore operations, using the system of the present invention, as the coiled tubing 102 is advanced into the wellbore 222 by unreeling it from the module 100, the coiled tubing 102 may be rotated by the top drive system 216 either continuously or intermittently. In an intermittent operation mode, the top drive may be stopped rotating the coiled tubing module 100 at varying time intervals while the unreeling of the coiled tubing 102 from the coiled tubing module is still continuing.

In one embodiment, the coiled tubing 102 may include metallic tubing, preferably, steel tubing. The coiled tubing 102 may be made of other materials such as composite materials. An outside diameter (OD) for the coiled tubing 102 may be in the range of 1-4 inches, preferably 1-2 ⅜ inches, and the length may be in the range of 500-20000 feet, preferably 5000-20000 feet depending on the wellbore length.

The coiled tubing module 100 of the present invention is a portable module and can be used with any rotary drilling rig, especially with rigs operating jointed pipe strings to drill wellbores. The coiled tubing module 100 can be advantageously transported to a site of a drilling rig configured for rotary jointed pipe drilling operations and installed on such rig, thereby replacing drilling mode from rotary jointed pipe drilling to rotary coiled tubing drilling.

Figure 2A:
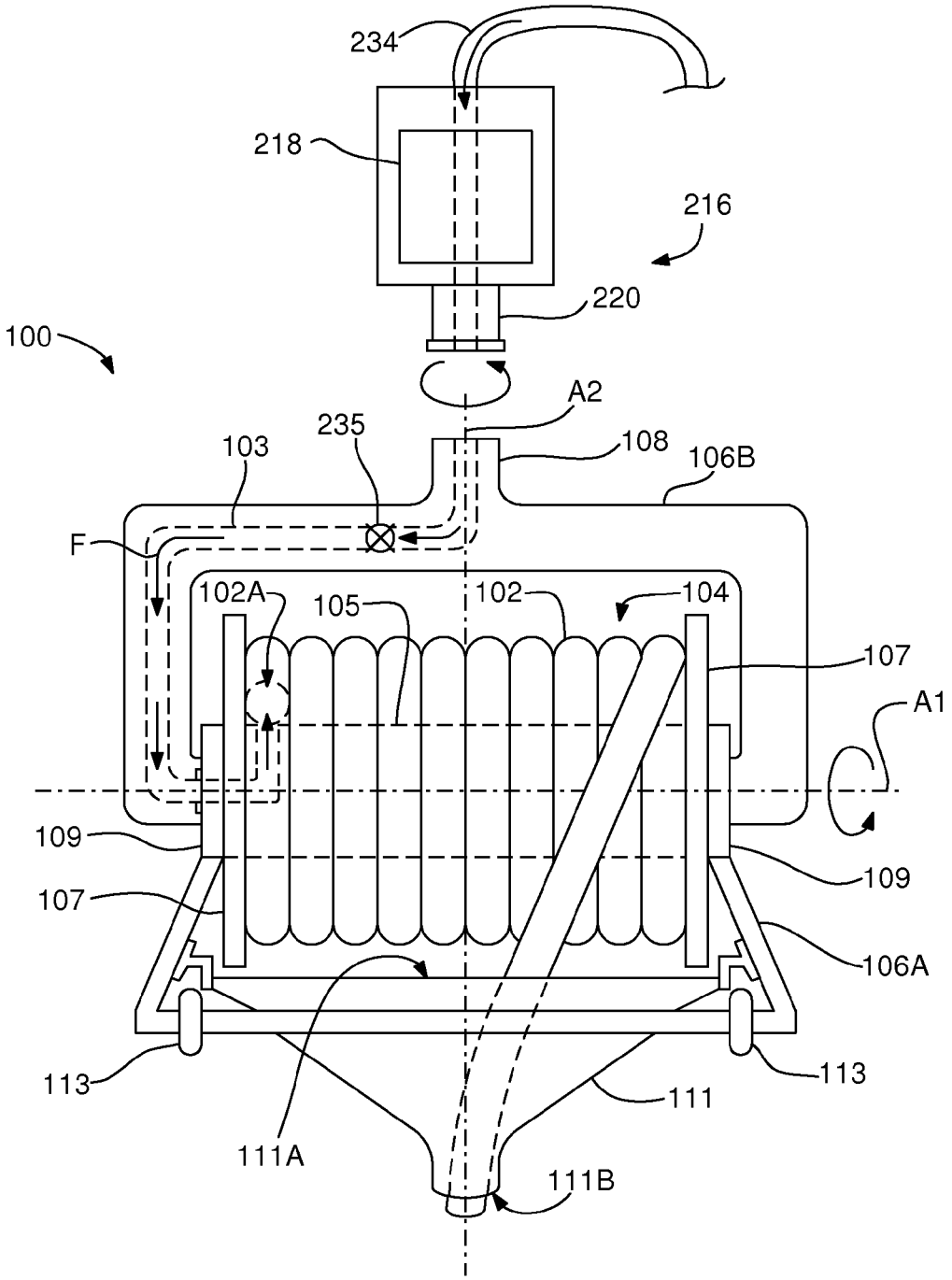
FIG. 2A is a schematic front view of the coiled tubing module shown in FIG. 1.

The coiled tubing module 100 includes a coiled tubing reel 104 to store the coiled tubing 102 or continuous tubing which is wound around a reel drum or spindle (shown in FIG. 2A). The coiled tubing reel 104 of the coiled tubing module 100 may be supported by a support structure 106 having a lower support structure 106A and an upper support structure 106B. A connector section 108 of the upper support structure 106B may be adapted to connect the coiled tubing module 100 to the top drive system 216 by engaging the gripping tool 220 of the top drive system. The coiled tubing 102 may be unreeled and extended into the wellbore 222 by rotating the coiled tubing reel 104 using a reel drive system (FIGS. 3A-3C) disposed on the coiled tubing module 100. As the coiled tubing 102 exits the coiled tubing reel 104 during drilling operations, it may be guided, straightened and injected by a guidance system 110. The guidance system 110 may include a guide 111 which may be a funnel shaped metallic shell including an upper opening 111A to receive the coiled tubing 102 exiting the coiled tubing reel 104 and a lower opening 111B to guide the coiled tubing towards the wellbore 222. The upper opening 111A of the guide 111 may be attached to the support structure 106 by the upper opening 111A. The guidance system 110 may also include a traversing system (not shown) serving to wind the coiled tubing evenly across the reel by moving back and forth either the guide 111 or the coiled tubing 102 when the coiled tubing is being rewound back onto the reel 104. The guidance system 110 may also include an injector/straightener device 112. The injector/straightener device 112 through which the coiled tubing passes may be disposed between the drill floor opening 223 and the lower opening 111B of the guide 111. The injector/straightener device 112 may be coupled to the lower opening 111B of the guide 111 so that when the coiled tubing module 100 is rotated by the top drive 216, the injector/straightener device 112 may also be rotated, which eliminates the need for another drive to rotate the injector/straightener device 112.

Drilling fluid and electrical power may be delivered to the coiled tubing module 100 via the top drive system 216. Electrical power may be used by the coiled tubing module to operate. Drilling fluid may be delivered to the coiled tubing module 100 by a mud pump 232 adjacent the rig 201 through a rig conduit 234 which may be connected to the top drive system 216. From the top drive system 216 including the gripping tool 220, a module conduit may be, for example, routed through hollow sections of the connector section 108 and the upper support structure 106B to deliver the drilling fluid to the coiled tubing 102 around the reel 104. A cable 236 to supply electrical power and to transfer data may also be included within the coiled tubing 102. The cable may establish a rapid data transfer line between a measurement and control unit (not shown) on the downhole tool 228 and an operation control center (not shown) of the system 200 on the surface to monitor and manage the drilling operation. The measurement and control unit may include a controller and/or various measurement sensors. The coiled tubing 102 may additionally pass through a safety valve 240, so called blowout preventer (BOP), disposed on the earth surface 227 before entering into the wellbore 222. The valve 240 may be adapted to cut and seal the coiled tubing 102 in order to close the wellbore 222 in an emergency situation.

A bottom hole assembly (BHA) 224, with a bent sub 226 including a mud motor 228 or downhole tool and a drill bit 230, may be connected to a lower opening 102B of the coiled tubing 102. The face angle of the drill bit 230 may be controlled in azimuth and inclination to drill a deviated wellbore. The drilling bit 230 may be rotated by the mud motor 228 of the BHA 224, which is supplied with drilling fluid from the mud pump 232, to drill into the earth. An exemplary wellbore operation using the rotary coiled tubing system 200 of the present invention with the BHA 224 may be performed by unreeling the coiled tubing 102 while simultaneously rotating the coiled tubing 102 and while continuously rotating the drill bit 230 of the BHA 224. Another exemplary wellbore operation may be performed by unreeling the coiled tubing 102 while intermittently rotating the coiled tubing 102 and while continuously rotating the drill bit 230 of the BHA 224. In an alternative embodiment, a drill bit without a BHA or mud motor may be attached to the lower opening 102B of the coiled tubing to be rotated by the rotating coiled tubing 102 to perform the drilling activity. The cuttings produced as the drill bit 230 drills into the earth are carried out of the wellbore 222 by drilling fluid supplied via the coiled tubing 102.

The rotary coiled tubing drilling system 200 of the present invention may drill at least a portion of the wellbore 222 or the entire wellbore 222 using the rotary coiled tubing as described above. Alternatively, the system 200 may drill the wellbore using both the rotary jointed pipe string and the rotary coiled tubing. For example, in one embodiment, a first drilling operation may be performed in the system 200 using the jointed pipe string from the drilling rig 201 to drill a first section D1 of a wellbore, which may be a vertical section extending from the surface 227. In the following step, the jointed pipe string is withdrawn from the wellbore, and a casing may be run in the first section D1 of the wellbore and cemented. Next, a second drilling operation may be performed using the rotary coiled tubing from the rig 201 to continue drilling the production hole by drilling a second section D2 of the wellbore. The second section may be a deviated section. The diameter of the second section D2 of the wellbore 222 may be smaller than the diameter of the first section D1 of the wellbore 222. The process may continue drilling a third or fourth sections with the rotary coiled tubing to extend the deviated section of the wellbore 222. Typically, when it is completed, a wellbore may have three of more consecutive wellbore sections with reduced diameter, first diameter being the largest and the last diameter being the smallest, and the corresponding casing and cementing steps.

Figure 2B:
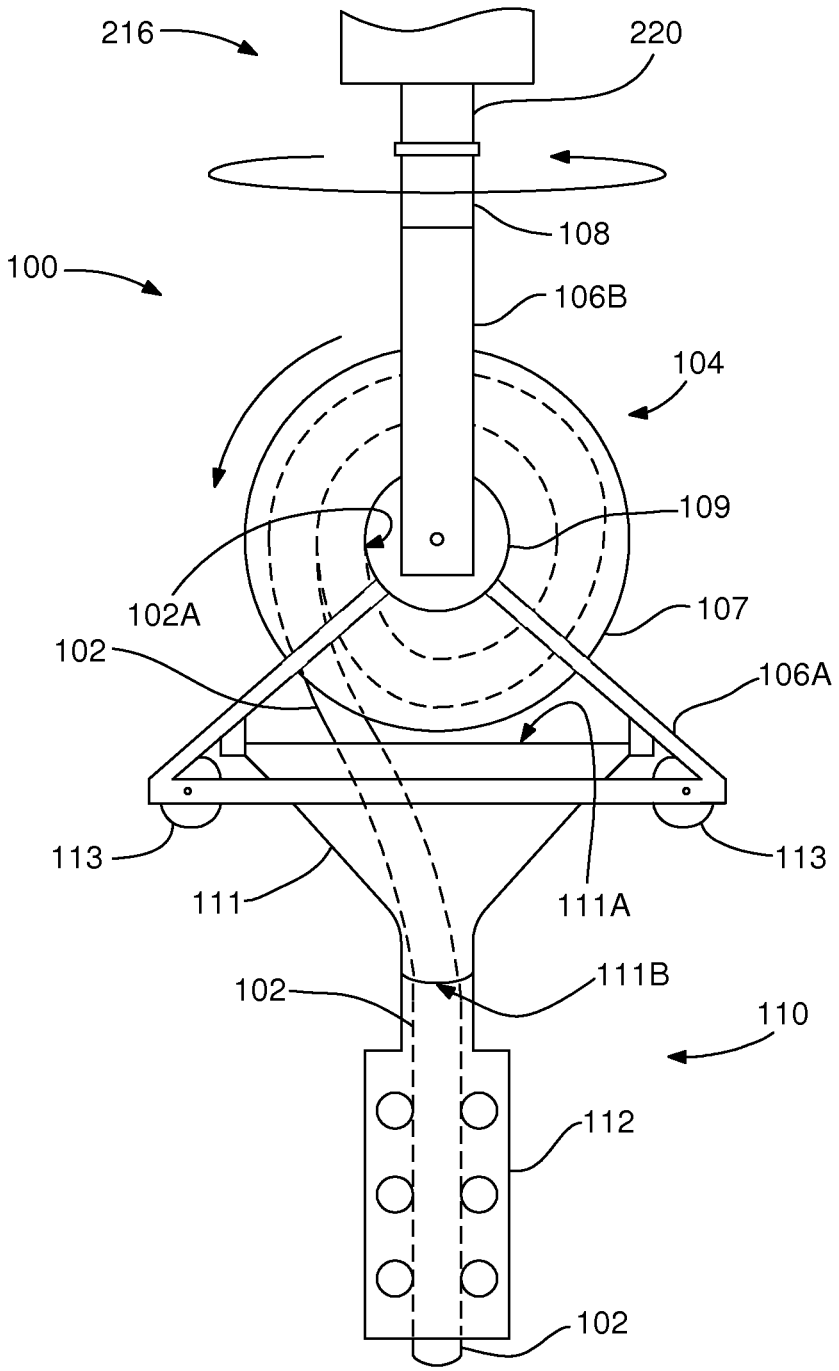
FIG. 2B is a schematic side view of the coiled tubing module shown in FIG. 1.

Referring to FIGS. 2A and 2B, the coiled tubing 102 may be wound around a drum 105 or reel core extending between side supports 107 of the coiled tubing reel 104. The lower support structure 106A and the upper support structure 106B may be adapted to be coupled to the coiled tubing reel 104 at centers of side supports 107 to support the module 100 during transportation and operations. The support structures 106A and 106B may be coupled to joint sections 109 located at centers of the side supports 107. The lower support structure 106A includes wheels 113 or rollers to help move around the coiled tubing module 100 before and after transportation, storage or installation. The coiled tubing module 100 may receive the drilling fluid depicted with arrows F from the top drive system 216 via the gripping tool 220. The drilling fluid F may be delivered to the top drive system 216 through the rig conduit 234 from the mud pump 232 as shown in FIG. 1. As shown in FIG. 2A, the guide 111 of the guidance system 110 may be coupled to the lower support structure 106A, and as is further shown in FIG. 2B, the injector/straightener 112 of the guide system 110 may be coupled to the guide 111. The rig conduit 234 may be controlled by a fluid control system 235 such as a valve or valves. On the coiled tubing module 100, a module conduit 103, which may be routed through the hollow interior of the upper support structure 106B, may deliver the drilling fluid F to an upper opening 102A of the coiled tubing 102.

The module conduit 103 may be connected to the upper opening 102A of the coiled tubing via an opening of the drum 105 after routed through centrally located hollow sections in the joint section 109 and the side support 107 as in the manner shown in FIG. 2A. Electrical lines and the cable 236 (FIG. 1) from the top drive system 216 may also be routed in the same manner into the drum 105 to establish electrical connections with a reel drive and to continue within the coiled tubing 102 respectively. As will be described more fully below, during a rotary coiled tubing drilling operation, the coiled tubing reel 104 may be rotated in a first rotational direction about a first axis denoted with A1 by a reel drive to unreel the coiled tubing 102 and advance it into the wellbore from the coiled tubing module 100. In this respect, the coiled tubing module 100 may be rotated in a second rotational direction about a second axis denoted with A2 which is aligned with the axis of the wellbore section that is immediately below the rig 201 shown in FIG. 1, for example with the axis of the first section D1 of the wellbore 222, which may be vertical. The rotation about the second axis A2 advantageously applies torque to the coiled tubing 102 within the wellbore and enables directional drilling resulting in a deviated wellbore as exemplified in FIG. 1. Referring to FIGS. 1-2B, due to its funnel shape, the guide 111 of the guidance system 110 directs the coiled tubing advanced from the reel toward the second axis A2, i.e., the rotational axis of the coiled tubing module 100. The coiled tubing 102 fed from the reel 104 advances substantially along the second axis A2 as it is traveling through the guidance system 110. During a wellbore operation, the rotation of the coiled tubing reel 104 and the coiled tubing module 100 may be done simultaneously or sequentially.

Figure 3A:
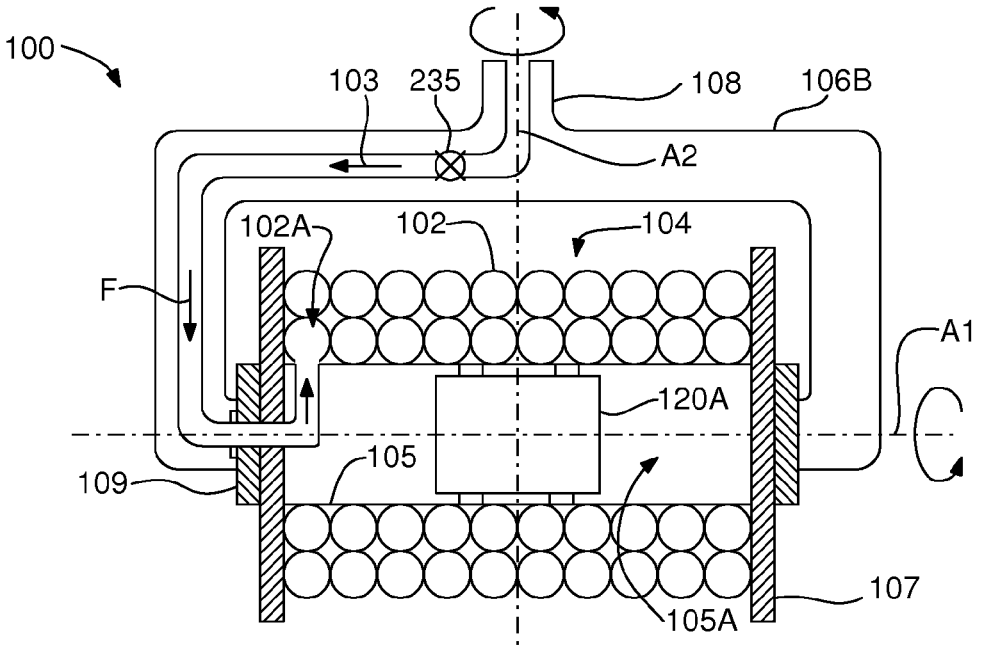
FIGS. 3A-3C are schematic views of various embodiments of coiled tubing modules with reel drive systems.
Figure 3B:
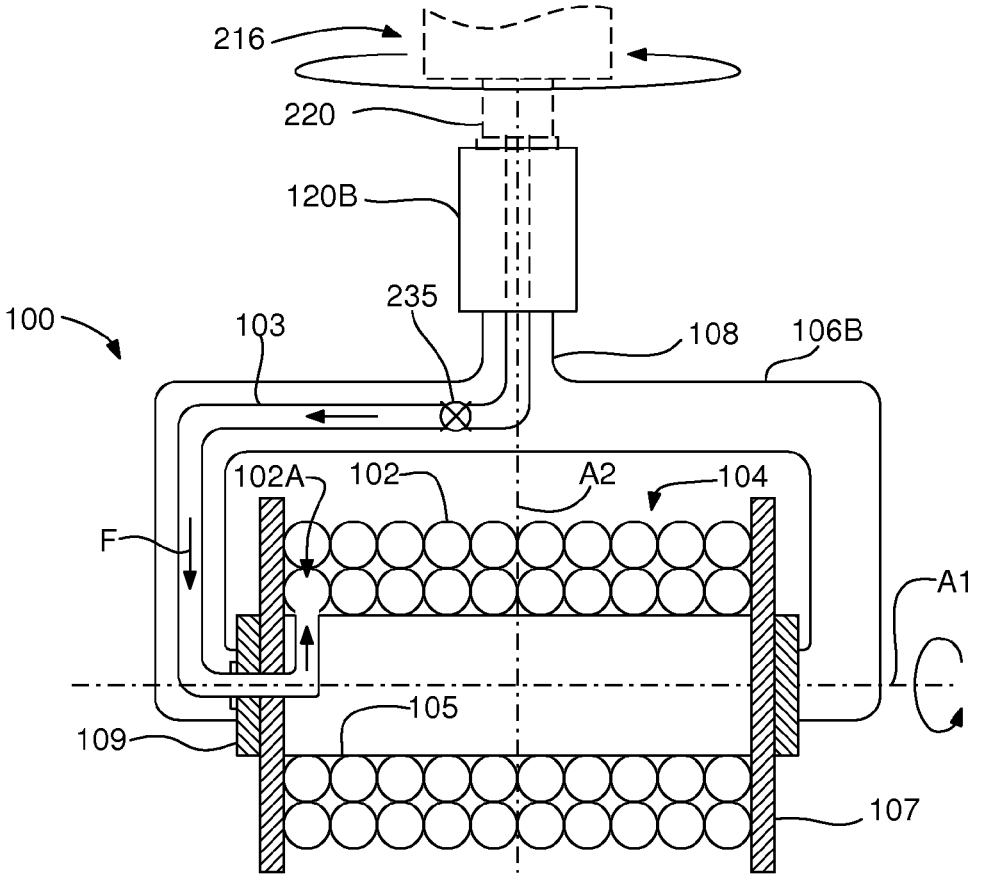
Figure 3C:
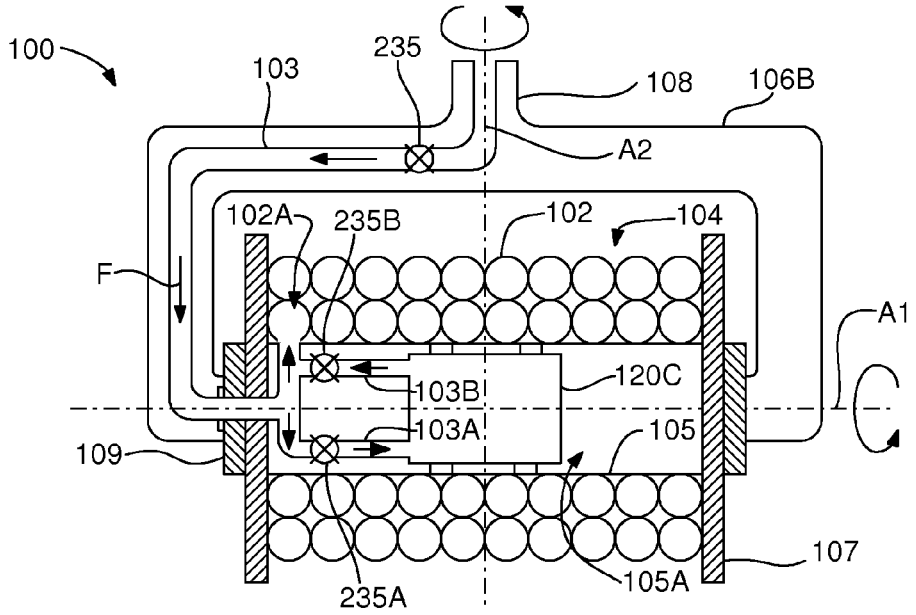

FIGS. 3A-3C show various embodiments of a reel drive system 120 adapted to rotate the coiled tubing reel 104 to unreel the coiled tubing 102 from the coiled tubing module 100. The lower support structure 106A and the guidance system are not shown in FIGS. 3A-3C for clarity purposes. Referring to FIG. 3A, a reel drive system 120A may be disposed within the reel drum 105 and adapted to rotate the coiled tubing reel 104 about the axis A1 during a rotary coiled tubing drilling operation. The reel drive system 120A may include a motor, preferably an electrical motor. A suitable mechanism including mechanical connectors, for example a shaft, chain, gears, clutch and the like, connects the electrical motor to the reel 105 so as to rotate the reel 104. The electrical lines for the reel drive system 120A may be routed from the top drive system 216 as described above. Referring to FIG. 3B, a reel drive system 120B may be disposed at the connector section 108 of the upper support structure 106B and adapted to rotate the coiled tubing reel 104 about the axis A1 during drilling operation. In this embodiment griping tool 220 of the top drive system 216 may be coupled to the reel drive 120B. The reel drive system 120B may include a motor, preferably an electrical motor. A suitable mechanism including mechanical connectors for example a shaft, chain, gears, clutch and the like, connects the electrical motor to the reel 105 so as to rotate the reel. The electrical lines (not shown) for the motor may be routed from the top drive system 216 or a rig service loop.

Referring to FIG. 3C, similar to the reel drive system 120A shown in FIG. 3A, a reel drive system 120C may be disposed within the reel drum 105 and adapted to rotate the coiled tubing reel 104 about the axis A1 during drilling operation. However, in this embodiment, the reel drive system 120C may include a hydraulic drive system, including a hydraulic motor, run by drilling fluid supplied from the module conduit 103. An inlet line 103A connects the module conduit 103 to the reel drive system 120C and provides fluid pressure needed to run the reel drive system 120C. An outlet line returns the drilling fluid F used by the reel drive system 120C to the module conduit 103. The inlet line 103A and the outlet line 103B include valves 235A and 235B, respectively, to control the pressure and flow rate of the drilling fluid flowing in and out of the reel drive system 120C. A mechanism including mechanical connectors, for example a shaft, chain, gears, clutch and the like, connects the hydraulic motor to the coiled tubing reel 105 so as to rotate the coiled tubing reel. The reel drive system 120B shown in FIG. 3B may also include a hydraulic drive system having a hydraulic motor run by drilling fluid supplied from the module conduit 103. To avoid undue vibration, in the above embodiments, the coiled tubing module components, such as the reel 104, the reel drive systems may be balanced along the axis of rotation A2 and/or counterbalances may be used on the revolving coiled tubing module to minimize vibration. In yet another embodiment, the top drive system 216 may be adapted to rotate the coiled tubing reel 104. A transmission system (not shown) extended from the top drive 216 may also rotate the coiled tubing reel 104 of the coiled tubing module 100 to unreel the coiled tubing 102 while the same top drive is used to rotate the coiled tubing module 100.

Figure 4:
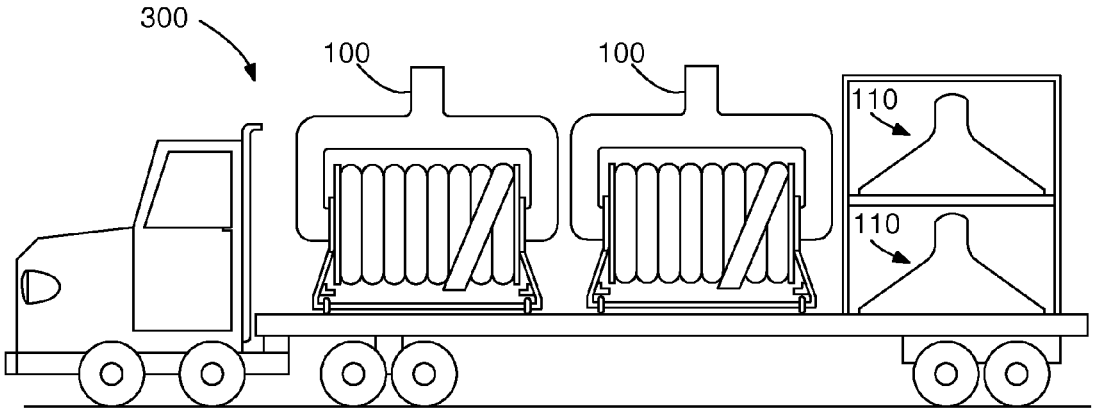
FIG. 4 is schematic views of portable coiled tubing modules while being transported on a truck to a well location.

FIG. 4 shows the portability of coiled tubing module 100. More than one coiled tubing module 100 may be transported to drilling fields on a truck 300. During transportation the guidance systems 110 may be stored separately. Once the coiled tubing module 100 arrives at the field, the guidance system 110 including the guide 111 and injector/straightener 112 can be quickly attached to the coiled tubing modules and the modules may be mounted on the rigs as described above.

Although aspects and advantages of the present invention are described herein with respect to certain preferred embodiments, modifications of the preferred embodiments will be apparent to those skilled in the art. Thus the scope of the present invention should not be limited to the foregoing discussion, but should be defined by the appended claims.

I claim:

1. A method of wellbore drilling, comprising:

providing a derrick having a derrick top and a derrick floor positioned over a wellbore, a top drive, disposed at the derrick top;

operating a jointed pipe drill string coupled to the top drive to drill a first section of the wellbore; and operating a coiled tubing from a coiled tubing module to drill a second section of the wellbore, wherein operating the coiled tubing comprising:

coupling the coiled tubing module to the top drive, the coiled tubing module including a reel structure adapted to support a reel of coiled tubing and a reel drive, unreeling the coiled tubing by rotating the reel of coiled tubing using the reel drive and extending the coiled tubing into the wellbore, and rotating the coiled tubing module using the top drive about a rotation axis of the top drive that is substantially aligned with the vertical axis of the wellbore and thereby transmitting torque to the coiled tubing extending into the wellbore.

2. The method of claim 1, wherein operating the coiled tubing further comprises aligning the coiled tubing with the wellbore using a guide and an injector of the coiled tubing module as the coiled tubing is unreeled from the reel and advanced into the wellbore.

3. The method of claim 1, wherein operating the coiled tubing further comprises causing the coiled tubing module to flow drilling fluid into the coiled tubing to run a tool bit attached to a distal end of the coiled tubing within the wellbore.

4. The method of claim 1, wherein the first section of the wellbore is a vertical section of the wellbore extending downwardly from the earth surface.

5. The method of claim 4, wherein the second section of the wellbore is a deviated section deviating from the vertical section.

6. The method of claim 1, wherein unreeling the coiled tubing includes rotating the reel of coiled tubing about an axis of rotation that is substantially orthogonal to a vertical axis of the wellbore.

7. The method of claim 1, wherein the reel drive is located within a reel drum of the reel around which the coiled tubing is wound.

8. The method of claim 1, wherein the reel drive is located on the reel structure of the coiled tubing module and adjacent the top drive.

9. The method of claim 1, wherein the reel drive includes one of an electrical motor and a hydraulic motor to rotate the reel.

10. The method of claim 3, wherein the coiled tubing includes a cable extending inside the coiled tubing and between a control center adjacent the derrick and sensors on a downhole tool including the tool bit to establish rapid data communication.

* * * * *